US005693459A

United States Patent [19]

Maskasky

[11] Patent Number: 5,693,459

[45] Date of Patent: *Dec. 2, 1997

[54] HIGH BROMIDE (111) TABULAR GRAIN EMULSIONS PRECIPITATED IN A NOVEL DISPERSING MEDIUM

[75] Inventor: Joe E. Maskasky, Rochester, N.Y.

[73] Assignee: Eastman Kodak Company, Rochester, N.Y.

[ * ] Notice: The term of this patent shall not extend beyond the expiration date of Pat. No. 5,604,085.

[21] Appl. No.: 669,684

[22] Filed: Jun. 24, 1996

[51] Int. Cl.[6] ..... G03C 1/005

[52] U.S. Cl. ..... 430/567; 430/603; 430/605; 430/637

[58] Field of Search ..... 430/567, 569, 430/637, 605, 603

[56] References Cited

U.S. PATENT DOCUMENTS

| | | | |
|---|---|---|---|
| 4,400,463 | 8/1983 | Maskasky | 430/434 |
| 4,439,520 | 3/1984 | Kofron et al. | 430/434 |
| 4,713,320 | 12/1987 | Maskasky | 430/567 |
| 4,713,323 | 12/1987 | Maskasky | 430/569 |
| 5,210,013 | 5/1993 | Tsaur et al. | 430/567 |
| 5,284,744 | 2/1994 | Maskasky | 430/569 |
| 5,604,085 | 2/1997 | Makasky | 430/567 |

OTHER PUBLICATIONS

Mees *The Theory of the Photographic Process*, Revised Ed., Macmillan, 1951, pp. 48–49.

James *The Theory of the Photographic Process*, 4th Ed., Macmillan, 1977, p. 51.

*Research Disclosure*, vol. 365, Sep. 1994, Item 36544, II.

*Research Disclosure*, vol. 176, Dec. 1978, Item 17643, IX.

*Research Disclosure*, vol. 308, Dec. 1989, Item 308119, IX.

*Primary Examiner*—Thorl Chea

*Attorney, Agent, or Firm*—Carl O. Thomas

[57] ABSTRACT

A radiation-sensitive emulsion is disclosed comprised of a dispersing medium and a coprecipitated grain population having a coefficient of variation of less than 30 percent. The coprecipitated grain population consists essentially of tabular grains containing greater than 50 mole percent bromide, based on silver, and having {111} major faces. The dispersing medium is comprised of (a) a cationic starch peptizer and (b) a polyalkylene oxide block copolymer surfactant.

17 Claims, No Drawings

HIGH BROMIDE (111) TABULAR GRAIN EMULSIONS PRECIPITATED IN A NOVEL DISPERSING MEDIUM

FIELD OF THE INVENTION

The invention relates to radiation-sensitive tabular grain silver halide emulsions useful in photography and radiography.

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

Gelatin and gelatin derivatives form both the peptizer and the major portion of the remainder of the vehicle in the overwhelming majority of silver halide photographic elements. An appreciation of gelatin is provided by this description contained in Mees *The Theory of the Photographic Process*, Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.

Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.

Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process*, 4th Ed., Macmillan, 1977, p. 51, states:

> Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure*, Vol. 365, September 1994, Item 36544, II. Vehicles, vehicle extenders, vehicle-like addenda and vehicle related addenda, A. Gelatin and hydrophilic colloid peptizers, paragraph (1) states:

> (1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . . .

This description is identical to that contained in *Research Disclosure*, Vol. 176, December 1978, Item 17643, IX. Vehicles and vehicle extenders, paragraph A. *Research Disclosure* is published by Kenneth Mason Publications, Ltd., Dudley House, 12 North St., Emsworth, Hampshire P010 7DQ, England.

During the 1980's a marked advance took place in silver halide photography based on the discovery that a wide range of photographic advantages, such as improved speed-granularity relationships, increased covering power, both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected high (>50 mole %) bromide tabular grain populations in photographic emulsions.

In descriptions of these emulsions, as illustrated by Kofron et al U.S. Pat. No. 4,439,520, the vehicle disclosure of *Research Disclosure* Item 17643 was incorporated verbatim. Only gelatin peptizers were actually demonstrated in the Examples.

Despite the assumption that conventional vehicle selections are fully applicable to tabular grain emulsions, there have been some indications that some peptizer selections are particularly advantageous for tabular grain emulsions. Maskasky (I) U.S. Pat. No. 4,400,463 disclosed the use of synthetic peptizers in combination with adenine to produce high (>50 mole %) chloride tabular emulsions. Later Maskasky (II & III) U.S. Pat. Nos. 4,713,320 and 4,713,323 demonstrated that high bromide and high chloride tabular grain emulsions could be improved by treating gelatin with an oxidizing agent. Tsaur et al U.S. Pat. No. 5,210,013 demonstrated that the dispersity of high bromide {111} tabular grains can be reduced by employing an alkyene oxide block copolymer in combination with gelatin.

Maskasky (IV) U.S. Pat. No. 5,284,744 taught the use of potato starch as a peptizer for the preparation of cubic grain silver halide emulsions, noting that potato starch has a lower absorption, compared to gelatin, in the wavelength region of from 200 to 400 nm. Maskasky '744 does not disclose tabular grain emulsions.

Related Patent Applications

Maskasky (V) U.S. Ser. No. 08/643,225, filed Dec. 19, 1995, commonly assigned, titled HIGH BROMIDE TABULAR GRAIN EMULSIONS IMPROVED BY PEPTIZER SELECTION, now allowed, discloses high bromide {111} tabular grain emulsions prepared in the presence of a cationic starch acting as a peptizer.

Maskasky (VI) U.S. Pat. No. 5,604,085, discloses ultrathin (0.07 μm) high bromide {111} tabular grain emulsions prepared in the presence of a cationic starch acting as a peptizer.

Maskasky (VII) U.S. Ser. No. 08/574,834, filed Dec. 19, 1995, commonly assigned, titled PHOTOGRAPHIC EMULSIONS IMPROVED BY PEPTIZER MODIFICATION, discloses high bromide {111} tabular grain emulsions prepared in the presence of an oxidized cationic starch acting as a peptizer.

Maskasky (VIII) U.S. Ser. No. 08/574,489, filed Dec. 19, 1995, commonly assigned, titled HIGH BROMIDE ULTRATHIN TABULAR GRAIN EMULSIONS IMPROVED BY PEPTIZER MODIFICATION, discloses ultrathin (<0.07 μm) high bromide {111} tabular grain emulsions prepared in the presence of an oxidized cationic starch acting as a peptizer.

SUMMARY OF THE INVENTION

In one aspect, this invention is directed to a radiation-sensitive emulsion comprised of a dispersing medium and a coprecipitated grain population having a coefficient of variation of less than 30 percent and consisting essentially of tabular grains containing greater than 50 mole percent bromide, based on silver, and having {111} major faces, wherein the dispersing medium is comprised of (a) a cationic starch peptizer and (b) a polyalkylene oxide block copolymer surfactant.

It has been discovered quite surprisingly that cationic starches are better suited for preparing high bromide {111} tabular grain emulsions than non-cationic starches and that cationic starches, when present in place of gelatin, facilitate photographic advantages.

Cationic starches exhibit lower levels of viscosity than have previously been present in preparing tabular grain emulsions. Reduced viscosity facilitates more uniform mixing. Both micromixing, which controls the uniformity of grain composition, mean grain size and dispersity, and bulk mixing, which controls scale up of precipitations to convenient manufacturing scales, are favorably influenced by the reduced viscosities made possible by cationic starch peptizers. Precise control over grain nucleation, including the monodispersity of the grain nuclei, is particularly important to successfully achieving and improving the properties of tabular grain emulsions.

Under comparable levels of chemical sensitization higher photographic speeds can be realized with cationic starches. Alternatively, lower temperatures can be employed during chemical sensitization of cationic starch peptized tabular grain emulsions to achieve photographic speeds equal or superior to those of gelatino-peptized emulsions. Lower temperatures have the advantage of protecting the tabular grains from unwanted ripening during chemical sensitization.

In a specifically preferred form of the invention the cationic starch employed as a peptizer is an oxidized cationic starch. Oxidized cationic starches have been demonstrated to offer still further advantages in terms of lower viscosities and lower temperatures of emulsion preparation and sensitization.

A disadvantage of tabular grain emulsions has been their dispersity, both in terms of the coefficient of variation of tabular grain sizes and the incidence of unwanted nontabular grains produced during tabular grain precipitations. While the substitution of cationic starch for gelatin has not been demonstrated to improve tabular grain dispersity, this invention demonstrates for the first time that combinations of polyalkylene oxide block copolymer surfactants and cationic starch in a dispersing medium during the precipitation of high bromide {111} tabular grain emulsions is capable of significantly lowering tabular grain dispersity as compared to emulsions comparably precipitated, but in the absence of the polyalkylene oxide surfactant. The compatibility of polyalkylene oxide block copolymer surfactants and cationic starch in the precipitation of tabular grain emulsions was never previously known nor predicted.

DEFINITION OF TERMS

The term "high bromide" in referring to silver halide grains and emulsions refers to grains and emulsions in which bromide accounts for greater than 50 mole percent of total halide, based on silver.

In referring to silver halide grains and emulsions containing more than one halide, the halides are named in order of ascending concentrations.

The term "tabular grain" refers to a grain having an aspect ratio of at least 2.

The term "aspect ratio" is the quotient of tabular grain equivalent circular diameter (ECD) divided by tabular grain thickness (t).

The term "tabular grain emulsion" refers to an emulsion in which tabular grains account for at least 50 percent of total grain projected area.

The term "coefficient of variation or COV" refers to average grain ECD divided by the standard deviation (σ) of grain ECD times 100.

The term "oxidized" in referring to starch indicates a starch in which, on average, at least one α-D-glucopyranose repeating unit per starch molecule has been ring opened by cleavage of the 2 to 3 ring position carbon-to-carbon bond.

The term "cationic" in referring to starch indicates that the starch molecule has a net positive charge at the pH of intended use.

The term "water dispersible" in referring to cationic starches indicates that, after boiling the cationic starch in water for 30 minutes, the water contains, dispersed to at least a colloidal level, at least 1.0 percent by weight of the total cationic starch.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch (which consists essentially of amylopectin) or high amylose corn starch.

DESCRIPTION OF PREFERRED EMBODIMENTS

The present invention is based on the discovery that superior radiation-sensitive high bromide tabular grain emulsions can be realized by employing an oxidized cationic starch peptizer in combination with a polyalkylene oxide block copolymer surfactant.

Any convenient technique for the precipitation of a radiation-sensitive high bromide tabular grain emulsion in the presence of an organic peptizer can be employed in the practice of this invention merely by substituting a water dispersible cationic starch and a polyalkylene oxide block copolymer surfactant for the organic peptizer.

The water dispersible cationic starch capable of acting as a peptizer can be obtained merely by modifying a conventional starch. Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

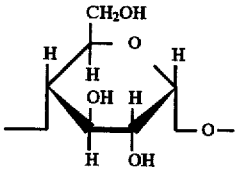

(I)

In amylopectin, in addition to the 1,4-bonding of repeating units, 6-position chain branching (at the site of the —$CH_2OH$ group above) is also in evidence, resulting in a branched chain polymer. It has been observed quite unexpectedly that superior tabular grain properties (e.g., higher average ECD's and aspect ratios) are realized when waxy corn starch, which consists essentially of amylopectin, is modified to a cationic form and employed for emulsion precipitation. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

In a preferred form the of the invention the starch is oxidized. The starch can be oxidized either before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

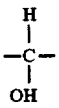

groups are commonly referred to as the glycol groups. The carbon-to-carbon bond between the glycol groups is replaced in the following manner:

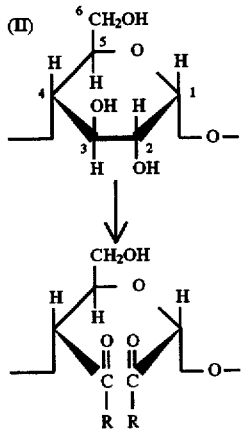

where R represents the atoms completing an aldehyde group or a carboxyl group.

The hypochlorite oxidation of starch is most extensively employed in commercial use. The hypochlorite is used in small quantities (<0.1% by weight chlorine, based on total starch) to modify impurities in starch, most notably to bleach colored impurities. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic or alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the precipitation of silver halide emulsions.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science*: Part A, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, Starch: *Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidised Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidised Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). However, it is generally preferred to avoid driving oxidation beyond levels required for viscosity reduction, since excessive oxidation results in increased chain cleavage. A typical convenient range of oxidation ring-opens from 3 to 50 percent of the α-D-glucopyranose rings.

The cationic starch can be substituted for any conventional gelatino-peptizer in the precipitation of a high bromide {111} tabular grain emulsion along with a polyalkylene oxide block copolymer surfactant. The primary function of this surfactant is to reduce grain dispersity. Specifically, the added presence of the surfactant has been observed to lower the COV of high bromide {111} tabular grain emulsions precipitated using the cationic starch as a peptizer.

Preferred polyalkylene oxide block copolymer surfactants for reducing the COV of the high bromide {111} tabular grain emulsions are selected from among S-I, S-II, S-III and S-IV categories.

The category S-I surfactants contain at least two terminal lipophilic alkylene oxide block units linked by a hydrophilic alkylene oxide block unit and can be, in a simple form, schematically represented as indicated by diagram I below:

| | | |
|---|---|---|
| LAO1 | HAO1 | LAO1 |

(S-I)

where

LAO1 in each occurrence represents a terminal lipophilic alkylene oxide block unit and HAO1 represents a hydrophilic alkylene oxide block linking unit.

It is generally preferred that HAO1 be chosen so that the hydrophilic block linking unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula S-Ia:

$$HO-(\overset{CH_3}{\overset{|}{C}}HCH_2O)_x-(CH_2CH_2O)_y-(CH_2\overset{CH_3}{\overset{|}{C}}HO)_{x'}-H \qquad \text{(S-Ia)}$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of at least 760 (preferably at least 1,000) to less than about 16,000 (preferably less than about 10,000) are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram SII below:

| | | |
|---|---|---|
| HAO2 | LAO2 | HAO2 |

where

HAO2 in each occurrence represents a terminal hydrophilic alkylene oxide block unit and LAO2 represents a lipophilic alkylene oxide block linking unit.

It is generally preferred that LAO2 be chosen so that the lipophilic block unit constitutes from 4 to 96 percent of the block copolymer on a total weight basis.

It is, of course, recognized that the block diagram S-II above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block linking unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula S-IIa:

$$HO-(CH_2CH_2O)_y-(\overset{\overset{CH_3}{|}}{C}HCH_2O)_x-(CH_2CH_2O)_{y'}-H \qquad \text{(S-IIa)}$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of at least 1,000 up to less than about 30,000 (preferably less than about 20,000) are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula S-IIIa below:

$$(H-HAO3)_z-LOL-(HAO3-H)_{z'} \qquad \text{(S-IIIa)}$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed in the practice of the invention can take the form shown in formula S-IIIb:

$$(H-HAO3-LAO3)_z-L-(LAO3-HAO3-H)_{z'} \qquad \text{(S-IIIb)}$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed in the practice of the invention can take the form shown in formula S-IIIc:

$$\begin{array}{ccc} & (R^1)_a-LAO3-HAO3-H & \\ & | & \\ & N & \\ H-HAO3-LAO3-(R^2)_b & & (R^3)_c-LAO3-HAO3-H \end{array} \qquad \text{(S-IIIc)}$$

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula S-IIIc.

When z+z' equal four, the linking group must be tetravalent. Diamines are preferred tetravalent linking groups. When a diamine is used to form the linking unit L, the polyalkylene oxide block copolymer surfactants employed in the practice of the invention can take the form shown in formula S-IIIc:

$$\begin{array}{ccccc} H-HAO3-LAO3-(R^5)_e & & & & (R^8)_g-LAO3-HAO3-H \\ & \diagdown & & \diagup & \\ & & N-R^6-N & & \\ & \diagup & & \diagdown & \\ H-HAO3-LAO3-(R^4)_d & & & & (R^7)_f-LAO3-HAO3-H \end{array} \qquad \text{(S-IIIc)}$$

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed in the practice of this invention contain at least three terminal lipophilic alkylene oxide block units linked through a hydrophilic alkylene oxide block linking unit and can be, in a simple form, schematically represented as indicated by formula S-IVa below:

$$(H-LAO4)_z-HOL-(LAO4-H)_{z'} \qquad \text{(S-IVa)}$$

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed in the practice of the invention can take the form shown in formula S-IVb:

$$(H—LAO4—HAO4)_z—L'—(HAO4—LAO4—H)_{z'} \quad \text{(S-IVb)}$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed in the practice of the invention can take the form shown in formula S-IVc:

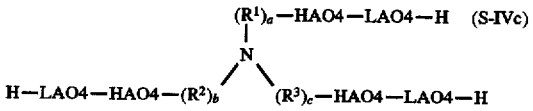

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula S-IVc.

When z+z' equal four, the linking group must be tetravalent. Dieunines are preferred tetravalent linking groups. When a diamine is used to form the linking unit L', the polyalkylene oxide block copolymer surfactants employed in the practice of the invention can take the form shown in formula S-IVd:

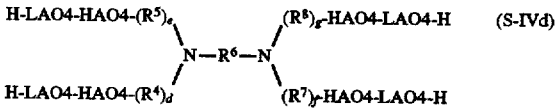

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H—HAO3—LAO3— or H—LAO4—HAO4— group satisfies formula III or IV, respectively:

$$H—(OCH_2CH_2)_y—(OC\overset{CH_3}{\overset{|}{H}}CH_2)_x— \quad \text{(III)}$$

$$H—(OC\overset{CH_3}{\overset{|}{H}}CH_2)_x—(OCH_2CH_2)_y— \quad \text{(IV)}$$

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula V $$—(OC\overset{R^9}{\overset{|}{H}}CH_2)— \quad \text{(V)}$$

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula VI:

$$-(OCH\overset{R^{10}}{\overset{|}{C}}H_2)- \quad \text{(VI)}$$

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Although the polyalkylene oxide block copolymer surfactants identified above are specifically preferred, any basically similar polyalkylene oxide block copolymer surfactants that have been employed to prepare high bromide {111} tabular grain silver halide emulsions can be employed, such as those of Tsaur et al U.S. Pat. Nos. 5,147,771, 5,147,772, 5,147,773, 5,171,659, 5,210,013 and 5,252,453 and Kim et al U.S. Pat. Nos. 5,236,817 and 5,272,048, incorporated by reference.

Both the cationic starch peptizer and the polyalkylene oxide block copolymer surfactant are present during precipitation of the high bromide {111} tabular grain emulsions. Preferably the peptizer and surfactant are both present in the reaction vessel prior to grain nucleation, during twin plane introduction into the grain nuclei, and subsequently during growth of the twin plane containing grain nuclei into tabular grains. Tabular grain nucleation can be conducted in the absence of either or both the peptizer and the surfactant, as illustrated by Mignot U.S. Pat. No. 4,334,012, here incorporated by reference. However, both are preferably present during twin plane formation and in the subsequent stages of precipitation.

To be effective to reduce tabular grain dispersity only very low levels of surfactant are required in the emulsion at the time parallel twin planes are being introduced. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 7 times the interim weight of silver. However, surfactant concentrations of up to 10 times the interim weight of silver are contemplated. During grain growth increased levels of surfactant can be employed without interfering with tabular grain growth.

The emulsions of the invention can be precipitated by conventional techniques for forming high bromide {111} tabular grain emulsions, except for the addition of the polyalkylene oxide block copolymer surfactant and substitution of cationic starch for conventional gelatino-peptizer, as described above. The following high bromide {111} tabular grain emulsion precipitation procedures, here incorporated by reference, are specifically contemplated to be useful in the practice of the invention, subject to the selected peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitouet al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Tsaur et al U.S. Pat. No. 5,252,453;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 mole percent bromide and optimally at least 90 mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent. It is generally preferred that the iodide concentration be less than 20 mole percent. Significant photographic advantages can be realized with iodide concentrations as low as 0.5 mole percent, with an iodide concentration of at least 1 mole percent being preferred.

The high bromide {111} tabular grain emulsions can exhibit mean grain ECD's ranging up to 15 μm. Mean grain ECD's of less than 10 μm are contemplated for the majority of applications. In most preferred uses, the tabular grain emulsions of the invention typically exhibit a mean ECD in the range of from about 0.2 to 5.0 μm. Tabular grain thicknesses typically range from about 0.03 μm to 0.3 μm. For blue recording somewhat thicker grains, up to about 0.5 μm, can be employed. For minus blue (red and/or green) recording, thin (<0.2 μm) tabular grains are preferred.

The advantages that tabular grains impart to emulsions generally increases as the average aspect ratio or tabularity of the tabular grain emulsions increases. Both aspect ratio (ECD/t) and tabularity ($ECD/t^2$) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 μm (preferably less than 0.2 μm) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

Conventional dopants can be incorporated into the silver halide grains during their precipitation, as illustrated by the patents cited above and *Research Disclosure*, Item 36544, cited above, Section I. Emulsion grains and their preparation, D. Grain modifying conditions and adjustments, paragraphs (3), (4) and (5). It is specifically contemplated to incorporate shallow electron trapping site providing (SET) dopants in the grains as disclosed in *Reseach Disclosure*, Vol. 367, November 1994, Item 36736.

It is also recognized that silver salts can be epitaxially grown onto the grains during the precipitation process. Epitaxial deposition onto the edges and/or corners of grains is specifically taught by Maskasky U.S. Pat. Nos. 4,435,501 and 4,463,087, here incorporated by reference. In a specifically preferred form high chloride silver halide epitaxy is present at the edges or, most preferably, restricted to corner adjacent sites on the host grains.

Although epitaxy onto the host grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure*, Item 36544, cited above, Section IV. Chemical sensitizations. For those few sensitizations that are improved by the presence of gelatin, it is recognized that gelatin can be added prior to sensitization. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions and peptizer adsorbed to the grain surfaces cannot be removed by washing.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

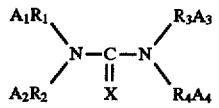

(VII)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VIII)}$$

wherein

L is a mesoionic compound;

X is an anion; and $L^1$ is a Lewis acid donor.

In another preferred form of the invention it is contemplated to employ alone or in combination with sulfur sensitizers, such as those formula I, and/or gold sensitizers, such as those of formula II, reduction sensitizers which are the 2-[N-(2-alkynyl)amino]-meta-chalcazoles disclosed by Lok et al U.S. Pat. Nos. 4,378,426 and 4,451,557, the disclosures of which are here incorporated by reference.

Preferred 2-[N-(2-alkynyl)amino]-meta-chalcazoles can be represented by the formula:

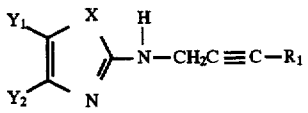

(IX)

where

X=O, S, Se;

$R_1$=(IVa) hydrogen or (IVb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula IV compounds are generally effective (with the IVb form giving very large speed gains and exceptional latent image stability) when present during the heating step (finish) that results in chemical sensitization.

Spectral sensitization of the emulsions of the invention is not required, but is highly preferred, even when photographic use of the emulsion is undertaken in a spectral region in which the grains exhibit significant native sensitivity. While spectral sensitization is most commonly undertaken after chemical sensitization, spectral sensitizing dye can be advantageous introduced earlier, up to and including prior to grain nucleation. Maskasky U.S. Pat. Nos. 4,435,501 and 4,463,087 teach the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. A general summary of useful spectral sensitizing dyes is provided by *Research Disclosure*, Item 36544, cited above, Section V. Spectral sensitization and desensitization.

While in specifically preferred forms of the invention the spectral sensitizing dye can act also as a site director and/or can be present during the finish, the only required function that a spectral. sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure*, Item 36544, cited above, Section II. Vehicles, vehicle extenders, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Item 36544, Section I. Emulsion grains and their preparation, E. Blends, layers and performance categories. Other common, but optional features are illustrated by *Research Disclosure*, Item 36544, Section VII, Antifoggants and stabilizers; Section VIII, Absorbing and scattering materials; Section IX, Coating physical property modifying agents; Section X, Dye image formers and modifiers. The features of Sections II and VII-X can alternatively be provided in other photographic element layers.

The photographic applications of the emulsions of the invention can encompass other conventional features, such as those illustrated by *Research Disclosure*, Item 36544, Sections:

XI. Layers and layer arrangements

XII. Features applicable only to color negative

XIII. Features applicable only to color positive

XIV. Scan facilitating features

XV. Supports

XVI. Exposure

XVII. Physical development systems

XVIII. Chemical development systems

XIX. Development

XX. Desilvering, washing, rinsing and stabilizing (post-development)

EXAMPLES

The invention can be better appreciated by reference to the following specific embodiments.

Example 1

Emulsion 1

AgBr Monodispersed Tabular Grain Emulsion Made Using a Cationic Corn Starch and a Polyalkene Oxide A polysaccharide solution was prepared by boiling for 30 min a stirred 400 g aqueous mixture containing 8.0 g of an oxidized cationic waxy corn starch 0.31 wgt % nitrogen and 0.00 wgt % phosphorous. (The polysaccharide, STA-LOK® 140 is 100% amylopectin that had been oxidized with 2 wgt % chlorine bleach. It was obtained from A. E. Staley Manufacturing Co., Decatur, Ill.)

The resulting solution was cooled to 40° C., readjusted to 400 g with distilled water, and 2.7 mmoles of NaBr, 14.7 mmoles of sodium acetate and 1.4 mg of Pluronic®-L43 obtained from BASF Corp. [Pluronic®-L43 has the following formula; $HO(CH_2—CH_2O)_6(CH_2—CH(CH_3)O)_{22}—(CH_2—CH_2O)_6H$]. To a vigorously stirred reaction vessel of the starch solution at 40° C., pH 5.0, was added 4M $AgNO_3$ solution and 4M NaBr solution, each at a constant rate of 10 mL per min. After 0.2 min., the addition of the solutions was stopped, 5.0 mL of 2M NaBr was added rapidly, and the temperature of the contents of the reaction vessel was increased to 60° C. at a rate of 5° C. per 3 min; then 2 mmoles of ammonium sulfate solution was added and the pH of the contents was adjusted to 10.6 in 2 minutes using 2.5M NaOH solution. After 9 additional min at pH 10.6, the contents were adjusted to a pH of 5.0 using 4M $HNO_3$. A 1M $AgNO_3$ solution was added at 0.5 mL per min and its addition rate was accelerated to reach a flow rate of 4.0 mL per min in 78 min until a total of 100 mL of this $AgNO_3$ solution had been added. A 1.09M NaBr solution was concurrently added at a rate needed to maintain a constant pBr of 1.44.

The resulting monodispersed tabular grain emulsion consisted of tabular grains with an average equivalent circular diameter of 2.2 μm, an average thickness of 0.075 μm, and an average aspect ratio of 29. The tabular grain population made up 99% of the total projected area of the emulsion grains. The tabular grain population had a $COV_{ECD}$ of 20%.

Emulsion 2 (Control)

AgBr Tabular Grain Emulsion Made Using a (Control) Cationic Corn Starch and no Polyalkene Oxide This emulsion was prepared similarly to Emulsion 1 except that no polyalkene oxide was added.

The resulting tabular grain emulsion consisted of tabular grains with an average equivalent circular diameter of 1.9 μm, an average thickness of 0.04 μm, and an average aspect ratio of 48. The tabular grain population made up 99% of the total projected area of the emulsion grains. The tabular grain population had a $COV_{ECD}$ of 38%.

Emulsion 3

AgBr Monodispersed Tabular Grain Emulsion Made Using a Cationic Corn Starch and a Polyalkene Oxide This emulsion was prepared similarly to Emulsion 1, except that the precipitation was stopped after 50 mL of the 1M $AgNO_3$ solution had been added.

The resulting tabular grain emulsion consisted of tabular grains with an average equivalent circular diameter of 1.67 μm, an average thickness of 0.075 μm, and an average aspect ratio of 22. The tabular grain population made up 99% of the total projected area of the emulsion grains. The tabular grain population had a $COV_{ECD}$ of 16%.

Example 2

This example demonstrates a preferred embodiment of the invention.

Emulsion 4

AgIBr (1.9 mole % I) Monodispersed Tabular Grain Emulsion Made Using a Cationic Corn Starch and a Polyalkene Oxide A polysaccharide solution was prepared by boiling for 30 min a stirred 400 g aqueous mixture containing 8.0 g of an oxidized cationic waxy corn starch 0.31 wgt % nitrogen and 0.00 wgt % phosphorous. (The polysaccharide, STA-LOK® 140 is 100% amylopectin that had been oxidized with 2 wgt % chlorine bleach. It was obtained from A. E. Staley Manufacturing Co., Decatur, Ill.)

The resulting solution was cooled to 40° C., readjusted to 400 g with distilled water, and 2.7 mmoles of NaBr, 14.7 mmoles of sodium acetate and 1.4 mg of Pluronic®-L43 obtained from BASF Corp. [Pluronic®-L43 has the following formula; $HO(CH_2—CH_2O)_6(CH_2—CH(CH_3)O)_{22}—(CH_2—CH_2O)_6H$]. To a vigorously stirred reaction vessel of the starch solution at 40° C., pH 5.0, was added 2M $AgNO_3$ solution at a constant rate of 10 mL per min. Concurrently, a 2M NaBr solution was added initially at 10 mL per min and then at a rate needed to maintain a pBr of 2.21. After 0.2 min., the addition of the solutions was stopped, 5.0 mL of 2M NaBr was added rapidly, and the temperature of the contents of the reaction vessel was increased to 60° C. at a rate of 5° C. per 3 min and maintained at 60° C. for 10 min. At 60° C., the $AgNO_3$ solution was added at 0.7 mL per min and its addition rate was accelerated to reach a flow rate of 2.0 mL per min in 36 min until a total of 12 mL of the $AgNO_3$ solution had been added. The NaBr solution was concurrently added at a rate needed to maintain a constant pBr of 1.44. The NaBr solution was then changed to a solution containing 2.01M NaBr and 0.05M KI. The acceleration was continued until a total of 50 mL of $AgNO_3$ solution had been added. The pBr was maintained at 1.44.

The resulting monodispersed tabular grain emulsion was comprised of tabular grains with an average equivalent circular diameter of 2.1 μm, an average thickness of 0.082 μm, and an average aspect ratio of 26. The tabular grain population made up 98% of the total projected area of the emulsion grains. The tabular grain population had a $COV_{ECD}$ of 19%.

Emulsion 5

AgIBr (1.9 mole % I) Tabular Grain Emulsion Made Using a Cationic Corn Starch

This emulsion was prepared similarly to Emulsion 4, except that no polyalkene oxide was added. The resulting tabular grain emulsion was comprised of tabular grains with an average equivalent circular diameter of 2.9 μm, an average thickness of 0.065 μm, and an average aspect ratio of 45. The tabular grain population made up 99% of the total projected area of the emulsion grains. The tabular grain population had a $COV_{ECD}$ of 35%.

Example 3

This example demonstrates the effect of varying the polysaccharides employed as peptizers.

Emulsions 6 to 32

These emulsions demonstrate the precipitation of tabular grain emulsions using a cationic starch derived from different plant sources, including a variety of potato and grain sources. The starches were selected to demonstrate a wide range of nitrogen and phosphorus contents. Variations in emulsion precipitation conditions are also demonstrated. Particularly significant is the demonstration that all of the cationic starch used for the entire precipitation can be added prior to grain nucleation.

Emulsion 6

AgIBr (3 mole % I) Tabular Grain Emulsion Made Using a Cationic Potato Starch

A starch solution was prepared by boiling for 30 min a stirred mixture of 80 g cationic potato starch (STA-LOK® 400, obtained from A. E. Staley Manufacturing Co., Decatur, Ill.), 27 mmoles of NaBr, and distilled water to 4 L. The cationic starch was a mixture of 21% amylose and 79% amylopectin and contained 0.33 wt % nitrogen in the form of a quaternary trimethyl ammonium alkyl starch ether and 0.13 wt % natural phosphorus. The cationic starch had an average molecular weight is 2.2 million. The resulting solution was cooled to 35° C., readjusted to 4 L with distilled water, and the pH was adjusted to 5.5. To a vigorously stirred reaction vessel of the starch solution at 35° C., a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The salt solution was concurrently added at a rate needed to maintain a constant pBr of 1.76. The resulting tabular grain emulsion was washed by diafiltration at 40° C. to a pBr of 3.38.

The tabular grain population of the resulting tabular grain emulsion was comprised of tabular grains with an average equivalent circular diameter of 1.2 μm, an average thickness of 0.06 μm, and an average aspect ratio of 20. The tabular grain population made up 92% of the total projected area of the emulsion grains. The emulsion grains had a coefficient of variation in diameter of 18%.

Emulsion 7

AgIBr (3 mole % I) Tabular Grain Emulsion Made Using a Cationic Corn Starch

A starch solution was prepared by boiling for 30 min a stirred 400 g aqueous mixture containing 2.7 moles of NaBr and 8.0 g of a cationic hybrid corn starch (CATO® 235, obtained from National Starch and Chemical Company, Bridgewater, N.J.) containing 0.31 wt % nitrogen and 0.00 wt % phosphorous.

The resulting solution was cooled to 35° C., readjusted to 400 g with distilled water. To a vigorously stirred reaction vessel of the starch solution at 35° C., pH 5.5 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the $AgNO_3$ solution was added at 1.0 mL per min for 1 min then its addition rate was accelerated to reach a flow rate of 5 mL per min in 30 min until a total of 100 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.6 μm, an average thickness of 0.06 μm, and an average aspect ratio of 27. The tabular grain population made up 85% of the total projected area of the emulsion grains.

Emulsion 8

AgIBr (3 mole % I) Tabular Grain Emulsion Made Using a Cationic Amphoteric Potato Starch This emulsion was prepared similarly to Emulsion 7, except that the starch used was a cationic amphoteric potato starch (Wespol A®, obtained from Western Polymer Corporation, Moses Lake, Wash.) containing both a quaternary trimethyl ammonium alkyl starch ether, 0.36 wt % nitrogen, and orthophosphate (0.70 wt % phosphorous) substituents.

The tabular grain population of the resulting emulsion was comprised of tabular grains with an average equivalent circular diameter of 1.7 μm, an average thickness of 0.05 μm, and an average aspect ratio of 34. The tabular grain population made up 95% of the total projected area of the emulsion grains.

Emulsion 9

AgIBr (3 mole % I) Tabular Grain Emulsion Made Using a Cationic Amphoteric Potato Starch This emulsion was prepared similarly to Emulsion 8, except that the precipitation was stopped after 50 mL of the $AgNO_3$ solution was added.

The tabular grain population of the resulting emulsion was comprised of tabular grains with an average equivalent circular diameter of 1.0 μm, an average thickness of 0.045 μm, and an average aspect ratio of 25. The tabular grain population made up 95% of the total projected area of the emulsion grains.

Emulsion 10

AgIBr (3 mole % I) Tabular Grain Emulsion Made Using a Cationic Potato Starch and at pH 2.0.

This emulsion was prepared similarly to Emulsion 7, except that the emulsion was precipitated at pH 2.0 and the starch used was cationic potato starch (STA-LOK® 400).

The tabular grain population of the resulting emulsion was comprised of tabular grains with an average equivalent circular diameter of 1.5 μm, an average thickness of 0.06 μm, and an average aspect ratio of 22. The tabular grain population made up 80% of the total projected area of the emulsion grains.

Emulsion 11

AgIBr (3 mole % I) Tabular Grain Emulsion Made Using a Cationic Corn Starch

This emulsion was prepared similarly to Emulsion 7, except that the emulsion was precipitated at pH 6.0, and the starch used was a cationic waxy corn starch (STA-LOK® 180, obtained from A. E. Staley Manufacturing Co.) made up of 100% amylopectin derivatized to contain 0.36 wt % nitrogen in the form of a quaternary trimethyl ammonium alkyl starch ether and 0.06 wt % phosphorous, average molecular weight 324,000.

The tabular grain population of the resulting emulsion was comprised of tabular grains with an average equivalent circular diameter of 1.6 μm, an average thickness of 0.06 μm, and an average aspect ratio of 27. The tabular grain population made up 91% of the total projected area of the emulsion grains.

Emulsion 12

AgBr Tabular Grain Emulsion Made by Adding 94% of a Cationic Potato Starch After Grain Nucleation A starch solution was prepared by boiling for 30 min a stirred 200 g aqueous mixture containing 3.75 mmoles of NaBr and 8.0 g of the cationic potato starch STA-LOK® 400.

To a vigorously stirred reaction vessel of 12.5 g of the starch solution (0.5 g starch), 387.5 g distilled water, and 2.2 mmole of NaBr at pH of 6.0 and 35° C. was added 2M $AgNO_3$ solution at a constant rate of 10 mL per min. Concurrently, a 2.5M NaBr solution was added initially at 10 mL per min and then at a rate needed to maintain a pBr of 2.21. After 0.2 min, the addition of the solutions was stopped, 2.5 mL of 2M NaBr was added rapidly, and the temperature of the contents of the reaction vessel was increased to 60° C. at a rate of 5° C. per 3 min. At 60° C., 187.5 g of the starch solution (7.5 g starch) was added, the pH was adjusted to 6.0 and maintained at this value throughout the remainder of the precipitation, and the $AgNO_3$ solution was added at 1.0 mL per min for 3 min and the NaBr solution was concurrently added at a rate needed to maintain a pBr of 1.76. Then the addition of the NaBr solution was stopped but the addition of the $AgNO_3$ solution was continued at 1.0 mL per min until a pBr of 2.00 was obtained. Then the addition of the $AgNO_3$ was accelerated at 0.05 mL per min squared and the NaBr solution was added as needed to maintain a pBr of 2.00 until a total of 0.20 mole of silver had been added.

The tabular grain population of the resulting emulsion was comprised of tabular grains with an average equivalent circular diameter of 1.0 μm, an average thickness of 0.055 μm, and an average aspect ratio of 18. The tabular grain population made up 90% of the total projected area of the emulsion grains.

Emulsion 13

AgIBr (3 mole % I) Tabular Grain Emulsion Made Using a Cationic Amphoteric Corn Starch This emulsion was prepared similarly to Emulsion 7, except that the starch used was a cationic amphoteric corn starch (STA-LOK® 356, obtained from A. E. Staley Manufacturing Co.) containing both a quaternary trimethyl ammonium alkyl starch ether (0.34 wt % nitrogen) and orthophosphate (1.15 wt % phosphorous) substituents. The cationic amphoteric starch was a mixture of 28% amylose and 72% amylopectin, with an average molecular weight of 486,000.

The tabular grain population of the resulting emulsion was comprised of tabular grains with an average equivalent circular diameter of 1.6 μm, an average thickness of 0.07 μm, and an average aspect ratio of 23. The tabular grain population made up 80% of the total projected area of the emulsion grains.

Emulsion 14

AgBr Tabular Grain Emulsion Made Using a Cationic Potato Starch

To a vigorously stirred reaction vessel containing 400 g of a solution at 35° C., pH 6.0 of 8.0 g cationic potato starch (STA-LOK® 400) and 6.75 mmolar in NaBr was added a 2M $AgNO_3$ solution at a rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly and the temperature was increased to 60° C. at a rate of 5° C. per 3 min. At 60° C., the $AgNO_3$ solution was added at 1.0 mL per min for 1 min then its addition rate was accelerated to 5 mL per min in 30 min then held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 2.2 μm, an average thickness of 0.08 μm, and an average aspect ratio of 28. The tabular grain population made up 85% of the total projected area of the emulsion grains.

Emulsion 15

AgIBr (3 mole % I) Tabular Grain Emulsion Made Using a Protonated Tertiary Aminoalkyl (Cationic) Corn Starch This emulsion was prepared similarly to Emulsion 7, except that the starch used was a corn starch (CATO-SIZE® 69, obtained from National Starch and Chemical Co.) that, as obtained, was derivatized to contain tertiary aminoalkyl starch ethers, 0.25 wt % nitrogen, 0.06 wt % phosphorus. At a pH of 5.5, the tertiary amino groups were protonated to render the starch cationic.

The tabular grain population of the resulting emulsion was comprised of tabular grains with an average equivalent circular diameter of 1.2 μm, an average thickness of 0.08 μm, and an average aspect ratio of 15. The tabular grain population made up 55% of the total projected area of the emulsion grains.

Emulsion 16

AgIBr (3 mole % I) Tabular Grain Emulsion Made Using a Cationic Potato Starch and at pH 5.5 and 80° C.

This emulsion was prepared similarly to Emulsion 7, except that the starch used was cationic potato starch (STA-LOK® 400) and the temperature was increased to 80° C. (instead of 60° C.).

The tabular grain population of the emulsion was comprised of tabular grains with an average equivalent circular diameter of 1.7 μm, an average thickness of 0.07 μm, and an average aspect ratio of 24. The tabular grain population made up 80% of the total projected area of the emulsion grains.

Emulsion 17

AgIBr (3 mole % I) Tabular Grain Emulsion Made Using a Cationic Corn Starch

This emulsion was prepared similarly to Emulsion 7, except that the starch used was a cationic corn starch (CATO® 25, obtained from National Starch and Chemical Company) containing 0.26 wt % nitrogen and 0.00 wt % phosphorous.

The tabular grain population of the resulting emulsion was comprised of tabular grains with an average equivalent circular diameter of 1.2 μm, an average thickness of 0.07 μm, and an average aspect ratio of 17. The tabular grain population made up 65% of the total projected area of the emulsion grains.

Emulsion 18

AgIBr (3 mole % I) Tabular Grain Emulsion Made Using a Cationic Corn Starch

This emulsion was prepared similarly to Emulsion 7, except that the starch used was a cationic corn starch (Clinton 788®, obtained from ADM Corn Processing, Clinton, Iowa) containing 0.15 wt % nitrogen and 0.00 wt % phosphorous.

The tabular grain population of the resulting emulsion was comprised of tabular grains with an average equivalent circular diameter of 1.0 μm, an average thickness of 0.08 μm, and an average aspect ratio of 13. The tabular grain population made up 60% of the total projected area of the emulsion grains.

Emulsion 19

AgIBr (3 mole % I) Tabular Grain Emulsion Made Using a Cationic Wheat Starch

This emulsion was prepared similarly to Emulsion 7, except that the starch used was a cationic wheat starch (K-MEGA® 53S, obtained from ADM/Ogilvie, Montreal, Quebec, Canada), which, as received was derivatized with a quaternary amine. The degree of substitution is 0.050 corresponding to 0.41 wt % nitrogen. The phosphorous was determined spectrophotometrically to be 0.07 wt %.

The tabular grain population of the resulting emulsion was comprised of tabular grains with an average equivalent circular diameter of 1.5 μm, an average thickness of 0.08 μm, and an average aspect ratio of 19. The tabular grain population made up 85% of the total projected area of the emulsion grains.

Emulsion 20

AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. At 50° C., the pH was adjusted to 6.0 and the $AgNO_3$ solution was added at 1.0 mL per min for 1 min, then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.2 μm, an average thickness of 0.10 μm, and an average aspect ratio of 12. The tabular grain population made up 70% of the total projected area of the emulsion grains.

Emulsion 21

AgIBr (3 mole % I) Tabular Grain Emulsion Made Using a Cationic Potato Starch of High Nitrogen Content A cationic potato starch solution containing a high nitrogen content was supplied by Western Polymer Corporation. The starch was 1.10 wt % in nitrogen and 0.25 wt % in natural phosphorous.

To 40 g of the starch solution, which contained 8 g of starch, was added 360 g distilled water and 2.7 moles of NaBr. This solution was placed in a reaction vessel and used to precipitate this emulsion using the procedure described in Example 3.

The tabular grain population of the resulting emulsion was comprised of tabular grains with an average equivalent circular diameter of 1.2 μm, an average thickness of 0.09 μm, and an average aspect ratio of 13. The tabular grain population made up 80% of the total projected area of the emulsion grains.

Emulsion 22

AgBr Tabular Grain Emulsion Made Using a Cationic Potato Starch

A starch solution was prepared by boiling for 30 min a stirred 400 g aqueous mixture containing 2.7 moles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a salt solution of 2.5M NaBr was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the pH was adjusted to 6.0 and the $AgNO_3$ solution was added at 1.0 mL per min for 1 min then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76. Then the addition of the NaBr solution was stopped and the flow rate of the $AgNO_3$ solution was dropped to 1 mL per min. When the pBr reached 2.28, the NaBr solution flow was resumed to maintain this pBr. After 60 min of growth at this pBr, the pBr was adjusted to 3.04 and maintained at this value until a total of 0.53 moles of silver had been added.

The tabular grain population of the resulting emulsion was comprised of tabular grains with an average equivalent circular diameter of 2.0 μm, an average thickness of 0.14 μm, and an average aspect ratio of 14. The tabular grain population made up 85% of the total projected area of the emulsion grains.

Emulsions 23 through 27

These emulsions demonstrate tabular grain preparation failures resulting from choosing noncationic starches as peptizers.

Emulsion 23

AgIBr (3 mole % I) Nontabular Grain Emulsion Made Using a Water-Soluble Carboxylated (Noncationic) Corn Starch This emulsion was prepared similarly to Emulsion 7, except that the starch used was a corn starch (FILMKOTE® 54, obtained from National Starch and Chemical Co.), which, as supplied, was derivatized to contain carboxylate groups. The nitrogen content was natural, 0.06 wt %.

A nontabular grain emulsion resulted.

Emulsion 24

AgIBr (3 mole % I) Nontabular Grain Emulsion Made Using a Water-Soluble Orthophosphate Derivatized (Noncationic) Potato Starch This emulsion was prepared similarly to Emulsion 7, except that the starch used was an orthophosphate derivatized potato starch 0.03 wt % nitrogen (natural), and orthophosphate substituents, 0.66 wt % phosphorous. The sample was obtained from Western Polymer Corporation.

A nontabular grain emulsion resulted.

Emulsion 25

AgIBr (3 mole % I) Nontabular Grain Emulsion Made Using a Water-Soluble Hydroxypropyl-substituted (Noncationic) Corn Starch.

This emulsion was prepared similarly to Emulsion 7, except that the starch (STARPOL® 530, was obtained from A. E. Staley Manufacturing Co.) used was a hydroxypropyl-substituted corn starch, 0.06 wt % nitrogen (natural) and 0.12 wt % phosphorous.

A nontabular grain emulsion resulted.

Example 26

AgIBr (3 mole % I) Nontabular Grain Emulsion Made Using a Water-Soluble (Noncationic) Potato Starch This emulsion was prepared similarly to Emulsion 7, except that the starch (Soluble Potato Starch obtained from Sigma Chemical Company, St. Louis, Mo.) used was a treated and purified water soluble potato starch, 0.04 wt % nitrogen and 0.06 wt % phosphorous.

A nontabular grain emulsion resulted.

Emulsion 27

AgIBr (3 mole % I) Nontabular Grain Emulsion Made Using a Water-Soluble (Noncationic) Wheat Starch This emulsion was prepared similarly to Emulsion 7, except that the starch (Supergel® 1400, obtained from ADM/Ogilvie, Montreal, Quebec, Canada) used was a water soluble noncationic wheat starch.

A nontabular grain emulsion resulted.

Emulsion 28

AgIBr (3 mole % I) Nontabular Grain Emulsion Made Using the Grain Protein Zein

This emulsion demonstrates to the failure of the grain protein zein to act as a peptizer.

In a stirred reaction vessel, 8.0 g of zein (obtained from Sigma Chemical Co.) in 400 g distilled water containing 2.7 mmole of NaBr was boiled for 60 min. Most of the zein did not appear to dissolve. The mixture was filtered and the filtrate was used as the starch solution to precipitate silver halide using conditions similar to those used in the preparation of Emulsion 7.

The resulting precipitation resulted in large clumps of nontabular grains.

Emulsions 29 through 32

These emulsions demonstrate tabular grain preparation failures resulting from choosing noncationic starch-like substances as peptizers.

Emulsion 29

AgIBr (3 mole % I) Nontabular Grain Emulsion Made Using the Noncationic Polysaccharide Dextran This emulsion was prepared similarly to Emulsion 7, except that the polysaccharide dextran (obtained from Sigma Chemical Co., St. Louis, Mo.), having a molecular weight of approximately 500,000, was employed.

The resulting precipitation resulted in large clumps of nontabular grains. Dextran was unable to peptize the silver halide grains.

Emulsion 30

AgIBr (3 mole % I) Nontabular Grain Emulsion Made Using the Noncationic Polysaccharide, Agar This emulsion was prepared similarly to Emulsion 7, except that the polysaccharide used was agar (purified, ash content <2%), obtained from Sigma Chemical Co.

The resulting precipitation resulted in large clumps and isolated nontabular grains. Agar was a poor peptizer for silver halide grains.

Emulsion 31

AgIBr (3 mole % I) Nontabular Grain Emulsion Made Using the Noncationic Polysaccharide Pectin This emulsion was prepared similarly to Emulsion 7, except that the polysaccharide used was pectin from citrus fruit (obtained from Sigma Chemical Co).

A nontabular grain emulsion resulted.

Emulsion 32

AgIBr (3 mole % I) Nontabular Grain Emulsion Made Using the Noncationic Polysaccharide, Gum Arabic This emulsion was prepared similarly to Emulsion 7, except that the polysaccharide used was gum arabic (obtained from Sigma Chemical Co.), having a molecular weight of about 250,000.

A nontabular grain emulsion resulted.

Emulsions 33 through 35

These emulsions confirm that the experimental conditions demonstrated above to produce tabular grain emulsions with cationic starch worked poorly using gelatin. While gelatin is a well known peptizer for the precipitation of tabular grain emulsions, the choice of adding all of the peptizer before grain nucleation, demonstrated above using cationic starches, hampered tabular grain emulsion preparation.

Emulsion 33

AgIBr (3 mole % I) Tabular Grain Emulsion Made Using Gelatin as Peptizer.

This emulsion was prepared similarly to Emulsion 7, except that oxidized bone gelatin was substituted for the starch.

The tabular grain population of the resulting emulsion was comprised of tabular grains with an average equivalent circular diameter of 2.2 μm, an average thickness of 0.07 μm, and an average aspect ratio of 31. The tabular grain population made up 60% of the total projected area of the emulsion grains, down from 85% in Emulsion 7.

Emulsion 34

AgIBr (3 mole % I) AgIBr Nontabular Grain Emulsion Made Using Gelatin as Peptizer.

This emulsion was prepared similarly to Emulsion 33, except that precipitation was terminated after the addition of 0.1 mole of silver nitrate.

The tabular grain population of the resulting emulsion was comprised of tabular grains with an average equivalent circular diameter of 2.0 μm, an average thickness of 0.06 μm, and an average aspect ratio of 33. The tabular grain population made up only 30% of the total projected area of the emulsion grains.

Emulsion 35

AgBr Nontabular Grain Emulsion Made Using Gelatin as Peptizer.

This emulsion was prepared similarly to Emulsion 7, except that oxidized bone gelatin was substituted for the starch and the precipitation growth temperature was 60° C., instead of 50° C.

The tabular grain population of the resulting emulsion was comprised of tabular grains with an average equivalent circular diameter of 3.2 μm, an average thickness of 0.07

μm, and an average aspect ratio of 46. The tabular grain population made up only 30% of the total projected area of the emulsion grains.

Emulsion 36

AgIBr (2.7 mole % I) Tabular Grain Emulsion

This emulsion was prepared in bone gelatin using conventional techniques favorable for the formation of tabular grain emulsions for the purpose of providing an emulsion with tabular grain thicknesses equal to or less than and tabular grain projected areas equal to or greater than those of the tabular grain emulsion precipitated in cationic starch reported in Emulsion 6.

The emulsion was diafiltered-washed to a pBr of 3.38 at 40° C. The tabular grains had an average equivalent circular diameter of 2.45 μm, an average thickness of 0.06 μm, and an average aspect ratio of 41. The tabular grain population made up 95% of the total projected area of the emulsion grains.

sole peptizer (OCS ONLY) as compared to a conventional emulsion employing gelatin as a peptizer (GEL ONLY).

Emulsion 37

AgIBr (2.7 mole % I) Tabular Grain Emulsion (GEL ONLY)

This emulsion was prepared in bone gelatin using published procedures. The emulsion was washed by diafiltration to a pBr of 3.38 at 40° C. The tabular grains had an average ECD of 2.45 μm, an average thickness of 0.06 μm, and an average aspect ratio of 41. The tabular grain population made up 95% of the total projected area of the emulsion grains.

Emulsion 38 (OCS ONLY)

AgIBr (3 mole % I) Ultrathin Tabular Grain Emulsion Made Using Oxidized Cationic Starch An oxidized cationic starch solution (OCS-1) was prepared by boiling for 30 min a stirred mixture of 80 g cationic potato starch, 27 moles of NaBr and distilled water to 4 L.

TABLE I

Emulsion Summary

| Emulsion | Peptizer | Cationic | Wt % Nitrogen | Wt % Phosphorus | Tabular Grains Present | Tabular Grains as % of Total Grain Projected Area |
|---|---|---|---|---|---|---|
| 6 | Potato Starch | Yes | 0.33 | 0.13[a] | Yes | 92 |
| 7 | Hybrid Corn S. | Yes | 0.31 | 0.00 | Yes | 85 |
| 8 | Potato Starch | Yes | 0.36 | 0.70 | Yes | 95 |
| 9 | Potato Starch | Yes | 0.36 | 0.70 | Yes | 95 |
| 10 | Potato Starch | Yes | 0.33 | 0.13[a] | Yes | 80 |
| 11 | Waxy Corn S. | Yes | 0.36 | 0.06[a] | Yes | 91 |
| 12 | Potato Starch | Yes | 0.33 | 0.13[a] | Yes | 90 |
| 13 | Potato Starch | Yes | 0.34 | 1.15 | Yes | 80 |
| 14 | Potato Starch | Yes | 0.33 | 0.13[a] | Yes | 80 |
| 15 | Corn Starch | Yes | 0.26 | 0.00 | Yes | 65 |
| 16 | Potato Starch | Yes | 0.33 | 0.13[a] | Yes | 80 |
| 17 | Corn Starch | Yes | 0.26 | 0.00 | Yes | 65 |
| 18 | Corn Starch | Yes | 0.15 | 0.00 | Yes | 60 |
| 19 | Wheat Starch | Yes | 0.41[b] | 0.07[a] | Yes | 85 |
| 20 | Potato Starch | Yes | 0.33 | 0.13[a] | Yes | 70 |
| 21 | Potato Starch | Yes | 1.10 | 0.25[a] | Yes | 80 |
| 22 | Potato Starch | Yes | 0.33 | 0.13[a] | Yes | 85 |
| (23) | Corn Starch | No | 0.06[a] | 0.00 | No | 0 |
| (24) | Potato Starch | No | 0.03[a] | 0.66 | No | 0 |
| (25) | Corn Starch | No | 0.06[a] | 0.00 | No | 0 |
| (26) | Potato Starch | No | 0.04[a] | 0.06 | No | 0 |
| (27) | Wheat Starch | No | NM | NM | No | 0 |
| (28) | Zein | No | NM | NM | No | 0 |
| (29) | Dextran | No | NM | NM | No | 0 |
| (30) | Agar | No | NM | NM | No | 0 |
| (31) | Pectin | No | NM | NM | No | 0 |
| (32) | Gum Arabic | No | NM | NM | No | 0 |
| (33) | Gelatin | NA | NA | NA | Yes | 60 |
| (34) | Gelatin | NA | NA | NA | Yes | 30 |
| (35) | Gelatin | NA | NA | NA | Yes | 30 |
| (36) | Gelatin | NA | NA | NA | Yes | 95 |

[a]Natural content
[b]Calculated from the degree of substitution.
NM = Not Measured
NA = Not Applicable Example 4

This example demonstrates the sensitometric advantages that can be realized when a high bromide {111} tabular grain emulsion is prepared through the step of chemical sensitization in the presence of an oxidized cationic starch as the The starch, STA-LOK® 400, was obtained from A. E. Staley Manufacturing Co., Decatur, Ill., and is a mixture of 21% amylose and 79% amylopectin, 0.33 wgt % nitrogen in the form of a quaternary trimethyl ammonium alkyl starch ether, 0.13 wgt % natural phosphorus, average molecular weight 2.2 million.

The resulting solution was cooled to 40° C., readjusted to 4 L with distilled water, and the pH adjusted to 7.9 with solid $NaHCO_3$ (1.2 g was required). With stirring, 50 mL of a NaOCl solution (containing 5 wgt % chlorine) was added along with dilute $HNO_3$ to maintain the pH between 6.5 to 7.5. Then the pH was adjusted to 7.75 with saturated $NaHCO_3$ solution. The stirred solution was heated at 40° C. for 2 hrs. The solution was adjusted to a pH of 5.5. The weight average molecular weight was determined by low-angle laser light scattering to be $>1\times10^6$.

To a vigorously stirred reaction vessel containing 4 L of the oxidized starch solution OCS-1 at 35° C., pH 5.5 a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 40 mL per min in 30 min and held at this flow rate until a total of 2 moles of silver had been added. The salt solution was concurrently added at a rate needed to maintain a constant pBr of 1.76. The pH was maintained at 5.5 throughout the precipitation.

The resulting tabular grain emulsion was washed by diafiltration at 40° C. to a pBr of 3.38. The tabular grains had an average ECD of 1.1 μm, an average thickness of 0.05 μm, and an average aspect ratio of 22. The tabular grain population made up 95% of the total projected area of the emulsion grains. The emulsion grains had a coefficient of variation in diameter of 21%.

Chemical Sensitizations

To 0.035 mole of the emulsion sample (see Table II, below) at 40° C., with stirring, were added sequentially the following solutions containing (mmole/mole Ag): 2.5 of NaSCN, 0.22 of a benzothiazolium salt, 1.5 of anhydro-5, 5'-dichloro-3,3'-bis(3-sulfopropyl)thiacyanine hydroxide, triethylammonium salt, and 0.08 of 1-(3-acetamidophenyl) -5-mercaptotetrazole, sodium salt. The pH was adjusted to 5.9. Then varied combinations of the following solutions were sequentially added (mmole/mole Ag): 0.023 of 2-propargylaminobenzoxazole (a reduction sensitizer labeled R in Table II below), 0.036 of 1,3-dicarboxymethyl-1,3-dimethyl-2-thiourea (a sulfur sensitizer labeled S in Table II below), and 0.014 of bis(1,3,5-trimethyl-1,2,4-triazolium-3-thiolate) gold (I) tetrafluoroborate (a gold sensitizer labeled Au in Table II below). The mixture was heated to the temperature given in Table II below at a rate of 5° C. per 3 min, and held at this temperature for 15 min. Upon cooling to 40° C., a solution of 1.68 of 5-bromo-4-hydroxy-6-methyl-1,3,3a,7-tetraazaindene was added.

The resulting blue spectrally and chemically sensitized emulsions were mixed with gelatin, yellow dye-forming coupler dispersion, surfactants, and hardener and coated onto clear support at 0.84 g/m$^2$ silver, 1.7 g/m$^2$ yellow dye-forming coupler, and 3.5 g/m$^2$ bone gelatin.

The coatings were exposed to blue light for 0.02 sec through a 0 to 4.0 log density graduated step tablet, processed in the Kodak Flexicolor C-41 ä color negative process using a development time of 3 min 15 sec.

The results are summarized in Table II. The GEL ONLY sample, S+Au+R sensitized at 55° C., was employed as the speed reference and assigned a relative speed of 100, measured at a density of 0.2 above minimum density (Dmin). Each relative speed unit difference between the relative speed of 100 and the reported relative speed represents 0.01 log E, where E represents exposure in lux-seconds.

TABLE II

Ultrathin Tabular Grain Emulsion Sensitization

| Sample | Sensitizer | Sens. Temp (°C.) | Dmax | Dmin | Mid-Scale Contrast | Rel. Speed |
|---|---|---|---|---|---|---|
| GEL ONLY | S + Au + R | 55 | 3.03 | 0.08 | 2.01 | 100 |
| OCS ONLY | S + Au | 50 | 3.13 | 0.21 | 2.01 | 203 |

Table II shows that, after sensitization, the photographic speed of OCS ONLY, sensitized at relatively low temperatures (45° C. and 50° C.) and without the 2-propargylaminobenzoxazole (R) was far superior to the other emulsions sensitized at similarly low temperatures, even when the propargyl compound (R) was added to boost speed. This demonstrates the lower sensitization temperatures that can be employed using an oxidized cationic starch as the sole peptizer.

Example 5

This example demonstrates the speed advantages of high bromide {111} tabular grain emulsions prepared through chemical sensitization in the presence of cationic starch as opposed to gelatin.

Four emulsion samples were compared.

The Emulsion 6, a high bromide {111} tabular grain emulsion, precipitated in the presence of cationic starch, was divided into three portions to form three samples. Two portions received no further treatment until sensitization, "Emulsion 6 STA" and "Emulsion 6 STA-Spectral". The samples were identical, but the latter sample received only spectral sensitization, instead of chemical and spectral sensitization, as in the case of the remaining emulsion samples.

To 0.81 mole of the third portion, "Emulsion 6 GEL", 20 g of bone gelatin in 100 mL distilled water were added. The purpose of adding gelatin was to demonstrate the effect of gelatin added as a vehicle after precipitation and before chemical sensitization, as is conventional practice.

A fourth sample was taken from Emulsion 37, a conventional silver iodobromide (2.7 mole % I) {111} tabular grain precipitated in bone gelatin. The purpose of providing this sample was to compare the properties of an emulsion precipitated in gelatin to the emulsions precipitated in the absence of gelatin and sensitized either in the presence or absence of gelatin.

Sensitization, coating, exposure and processing were undertaken as described in Example 4, except that all of the emulsion samples received sulfur, gold and reduction sensitizes.

The results are summarized in Table III.

TABLE III

| Emulsion Sensitized | $D_{max}$ | $D_{min}$ | Mid-Scale Contrast | Relative Speed at 0.2 above Dmin |
|---|---|---|---|---|
| Emulsion 37 | 3.03 | 0.08 | 2.01 | 100 |
| Emulsion 6 GEL | 2.86 | 0.09 | 1.79 | 115 |

TABLE III-continued

| Emulsion Sensitized | $D_{max}$ | $D_{min}$ | Mid-Scale Contrast | Relative Speed at 0.2 above Dmin |
|---|---|---|---|---|
| Emulsion 6 STA | 3.18 | 0.13 | 2.08 | 204 |
| Emulsion 6 STA-Spectral | 0.70 | 0.05 | 1.69 | −11 |

Emulsion 37, a conventional high bromide {111} tabular grain emulsion precipitated in the presence of gelatin, was employed as the speed reference. Emulsion 6 GEL, which was precipitated in cationic starch, but had gelatin added before chemical sensitization, exhibited a speed that was 15 relative speed units faster than the speed of control Emulsion 37. Thus, Emulsion 6 GEL was 0.15 log E (15 relative speed units=0.15 log E, where E is exposure in lux-seconds) faster than control Emulsion 37. This amounted to a speed advantage of (one-half stop).

An even larger speed advantage was demonstrated by Emulsion 6 STA. This emulsion, which precipitated and sensitized in the absence of gelatin, was 1.04 log E faster than control Emulsion 37. In other words, it was more than 10 times faster than the conventional control Emulsion 34 emulsion.

Emulsion 6 STA-Spectral was included to demonstrate that the cationic starch itself, apart from the chemical sensitizers, was not imparting the speed observed. Emulsion 6 STA-Spectral was 111 relative speed units (1.11 log E) slower than control Emulsion 37. From this it was concluded that the cationic starch was in some way permitting better interaction of the chemical sensitizer with the grain surface than is conventionally realized by employing gelatin as a peptizer.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and a coprecipitated grain population having a coefficient of variation of less than 30 percent and consisting essentially of tabular grains containing greater than 50 mole percent bromide, based on silver, and having {111} major faces, wherein said dispersing medium is comprised of (a) a cationic starch peptizer and (b) a polyalkylene oxide block copolymer surfactant.

2. A radiation-sensitive emulsion according to claim 1 wherein the cationic starch is comprised of at least one of α-amylose and amylopectin.

3. A radiation-sensitive emulsion according to claim 1 wherein the cationic starch consists essentially of amylopectin.

4. A radiation-sensitive emulsion according to claim 1 wherein the starch contains cationic moieties selected from among protonated amine moieties and quaternary ammonium, sulfonium and phosphonium moieties.

5. A radiation-sensitive emulsion according to claim 1 wherein the cationic starch contains α-D-glucopyranose repeating units having 1 and 4 position linkages.

6. A radiation-sensitive emulsion according to claim 5 wherein the cationic starch additionally contains 6 position linkages in a portion of the α-D-glucopyranose repeating units to form a branched chain polymeric structure.

7. A radiation-sensitive emulsion according to any one of claims 1 to 6 wherein the cationic starch is oxidized.

8. A radiation-sensitive emulsion according to claim 7 wherein oxidized cationic starch contains α-D-glucopyranose repeating units and, on average, at least one oxidized α-D-glucopyranose unit per starch molecule.

9. A radiation-sensitive emulsion according to claim 8 wherein from 3 to 50 percent of the α-D-glycopyranose units are ring opened by oxidation.

10. A radiation-sensitive emulsion according to claim 1 wherein polyalkylene oxide block copolymer is selected from the group consisting of $$\text{LAO1—HAO1—LAO1} \quad (1)$$

where

LAO1 in each occurrence represents a terminal lipophilic alkylene oxide block unit and HAO1 represents a hydrophilic alkylene oxide block linking unit, the HAO1 unit constitutes from 4 to 96 percent of the block copolymer on a weight basis, and the block copolymer has a molecular weight of from 760 to less than 16,000;

$$\text{HAO2—LAO2—HAO}_2 \quad (2)$$

where

HAO2 in each occurrence represents a terminal hydrophilic alkylene oxide block unit and LAO2 represents a lipophilic alkylene oxide block linking unit, the LAO2 unit constitutes from 4 to 96 percent of the block copolymer on a weight basis, and the block copolymer has a molecular weight in the range of from 1,000 to of less than 30,000;

$$(\text{H—HAO3})_z\text{—LOL—}(\text{HAO3—H})_{z'} \quad (3)$$

where

HAO3 in each occurrence represents a terminal hydrophilic alkylene oxide block unit, LOL represents a lipophilic alkylene oxide block linking unit, z is 2 and z' is 1 or 2, the LOL unit constitutes from 4 to 96 percent of the block copolymer on a weight basis, and the block copolymer has a molecular weight in the range of from greater than 1,100 to of less than 60,000; and $$(\text{H—LAO4})_z\text{—HOL—}(\text{LAO4—H})_{z'} \quad (4)$$

where

LAO4 in each occurrence represents a terminal lipophilic alkylene oxide block unit, HOL represents a hydrophilic alkylene oxide block linking unit, z is 2 and z' is 1 or 2, the HOL unit constitutes from 4 to 96 percent of the block copolymer on a weight basis, and the block copolymer has a molecular weight of from greater than 1,100 to less than 50,000.

11. A radiation-sensitive emulsion according to claim 1 wherein the cationic starch is dispersed to at least a colloidal level of dispersion.

12. A radiation-sensitive emulsion according to claim 1 wherein the cationic starch is at least in part present as an aqueous solute.

13. A radiation-sensitive emulsion according to claim 1 wherein the peptizer consists essentially of the cationic starch.

14. A radiation-sensitive emulsion according to claim 13 wherein the tabular grains are chemically sensitized.

15. A radiation-sensitive emulsion according to claim 14 wherein the tabular grains are chemically sensitized with at least one of sulfur, gold and reduction sensitizers.

16. A radiation-sensitive emulsion according to claim 14 wherein a photographic vehicle is combined with the chemically sensitized tabular grains.

17. A radiation-sensitive emulsion according to claim 16 wherein the photographic vehicle includes gelatin or a gelatin derivative.

* * * * *